United States Patent [19]

Hussein

[11] Patent Number: 4,708,880

[45] Date of Patent: Nov. 24, 1987

[54] ESSENTIAL OILS TREATED TO REMOVE HARSH NOTES THEREFROM

[75] Inventor: Mamoun M. Hussein, Mountain Lakes, N.J.

[73] Assignee: Nabisco Brands, Inc., Parsippany, N.J.

[21] Appl. No.: 891,722

[22] Filed: Jul. 29, 1986

Related U.S. Application Data

[63] Continuation-in-part of Ser. No. 727,646, Apr. 26, 1985, abandoned.

[51] Int. Cl.[4] ..... C11B 9/00

[52] U.S. Cl. ..... 426/424; 426/651; 426/312; 512/5

[58] Field of Search ..... 426/312, 600, 651, 424; 252/522

[56] References Cited

U.S. PATENT DOCUMENTS

| | | | |
|---|---|---|---|
| 2,040,661 | 5/1936 | Lubmann | 426/312 X |
| 2,510,498 | 6/1950 | Gaeng | 426/312 |
| 2,725,299 | 11/1955 | Platel et al. | 426/312 X |
| 4,376,130 | 3/1983 | Astrack et al. | 426/312 X |
| 4,613,513 | 9/1986 | Hussein | 426/651 |

FOREIGN PATENT DOCUMENTS

| | | | |
|---|---|---|---|
| 548889 | 10/1942 | United Kingdom | 426/312 |

*Primary Examiner*—Joseph Golian

*Attorney, Agent, or Firm*—Richard Kornutik

[57] ABSTRACT

Essential oils extracted from botanical material are treated with a peroxide-acid reagent to remove harsh flavor off-notes therefrom.

6 Claims, No Drawings

ESSENTIAL OILS TREATED TO REMOVE HARSH NOTES THEREFROM

CROSS REFERENCE TO RELATED PATENT APPLICATIONS

This patent application is a continuation-in-part of application Ser. No. 727,646 filed Apr. 26, 1985, and now abandoned.

BACKGROUND OF THE INVENTION

Field of the Invention

The present invention relates to essential oils extracted from botanical matter which are treated with a peroxide-acid reagent to remove harsh flavor notes therefrom.

Description of the Prior Art and Other Related Art

Essential oils which are freshly distilled from botanical matter usually have, when freshly made, what are known as harsh tasting flavor notes. These harsh flavor off-notes are also known as green, burnt, still off-notes. This is particularly true in the case of peppermint oil or spearmint oil which is freshly made by means of steam distillation of the present botanical matter from which the oil is extracted. The customary procedure employed for removing those harsh flavor notes which are present in the freshly obtained oil is to allow the oil to age or mellow for periods of about 6 to 24 months, in full containers in the presence of oxygen and in the absence of actinic radiation. This aging-mellowing process is economically unattractive since it requires the use of carefully monitored storage facilities, for long periods of time and supervised by technically trained personnel. All of these storage requirements are economically burdensome.

U.S. Pat. No. 4,478,864 discloses the treatment of freshly prepared peppermint oil with maleic anhydride for the purposes of preventing the formation of certain off flavor notes during the aging process. This process removes most of the menthofuran from the fresh peppermint oil, in the form of a menthofuran-maleic anhydride complex. Thus, very little menthofuran is present, during the aging process, to oxidize to produce undesirable flavor notes. This process, however, does not cure all the off-flavor note problems inherent in fresh peppermint oil. An essential oil treated by the process of U.S. Pat. No. 4,478,864 may still have to undergo an aging process to remove off-flavor notes that are present in the freshly prepared oil.

In U.S. patent application Ser. No. 727,509 filed by the present inventor on Apr. 26, 1985 and entitled "Essential Oils Treated To Remove Harsh Notes Therefrom", which has issued as U.S. Pat. No. 4,613,513 there is disclosed a process for treating essential oils with Fehlings solution to remove harsh flavor notes from the oils.

Prior to all of the present inventors work, therefor, it has not been possible to treat freshly made essential oils in a facile manner so as to readily remove therefrom harsh flavor off-notes then present therein with a reagent that can be readily removed from the oil.

OBJECTS OF THE PRESENT INVENTION

An object of the present invention is to provide essential oils which are freshly extracted from botanical matter and which are rendered free of harsh flavor off-notes present in the fresh, unaged oil.

A further object of the present invention is to provide a facile process for treating freshly extracted essential oils of botanical matter so as to readily render them free of harsh flavor off-notes then present therein.

SUMMARY OF THE PRESENT INVENTION

It has now been found according to the present invention that essential oils freshly extracted from botanical matter which then contain harsh flavor off-notes can be readily freed of such harsh flavor off-notes by treating the oil with a peroxide-acid reagent.

DESCRIPTION OF THE PREFERRED EMBODIMENT

The peroxide-acid reagent which is used to treat the essential oils in accordance with the present invention is a combination of one or more water soluble inorganic peroxides such as hydrogen peroxide and/or ozone and one or more water soluble inorganic acids such as hydrochloric acid, sulfuric acid and phosphoric acid. The peroxide is the active agent in the reagent system of the present invention. The acid is merely used to acidify the peroxide.

The acidified peroxide is employed in amounts which are sufficient to remove at least substantially, if not all, of the harsh off-flavor notes that are present. The amount of harsh flavor notes that are present will vary from one sample of the essential oil to another.

The acids are preferably employed as aqueous solutions having an acid concentration of about 10 to 40, and preferably of about 30 to 40, weight percent.

The hydrogen peroxide is preferably employed as an aqueous solution having a peroxide concentration of about 30 to 50, and preferably of about 30 to 40 weight %. The ozone is preferably employed at a concentration of about 1–5 ppm in deaerated water or at a concentration of about 0.2 to 0.3% in air (at 20° C.). The ozone is generated on site by techniques well known in the art.

Aqueous solutions of the peroxides and/or acids having higher or lower concentrations may also be used.

The peroxide and acid components of the reagent are added together to the oil to be treated therewith, as disclosed below.

The essential oils which are to be treated with the peroxide-acid reagent in accordance with the present invention are the freshly extracted essential oils of botanical matter. These oils are used as flavorants in the food, confectionary, perfume and cosmetic industries. These oils would include those obtained from the following botanical materials: anise, basil, dill weed, chamomile, eucalyptus, fennel, geranium, hop, laurel leaf, lemongrass, bois de rose, caraway, amber, camphor, amyris, galbanum, davana, mentha (spearmint and peppermint).

The essential oils which are to be treated with the peroxide-acid reagent in accordance with the present invention may be extracted from their parent botanical matter, ie, leaves, fruit, bark, root, grass, wood, heartwood, gum, balsam, berries, seed, flowers twigs and buds, by the commonly employed technique for doing so, i.e., steam distillation.

The fresh oil may be rectified (redistilled) prior to or after treatment with the peroxide-acid reagent to improve a particular property characteristic. For example, peppermint oil may be rectified to remove dimethyl sulfide therefrom which provides a green weedy note.

The harsh flavor off-notes in the fresh essential oils, which are to be removed by treatment with the peroxide-acid reagent, may be characterized, as such, organoleptically. Organoleptically these harsh off-flavor notes may be characterized as: harsh, green, raw, weedy, skunky and burnt.

The chemical components of the fresh essential oils which are believed responsible for the harsh (tasting) flavor off-notes have not been determined analytically. They are present, at most, at trace concentrations in the oil. When the essential oils are analyzed by gas chromatography prior to and after the treatment of the present invention, no apparent changes in the composition of the volatile components of the oil can be detected (analytically).

By volatile components it is meant those components of the oil which are volatile enough as to be capable of being detected by gas chromatography analysis using a Carbowax-20M column operated at a maximum temperature of 230° C. and with an injector temperature of a maximum of 250° C.

In treating the essential oil with the peroxide-acid reagent according to the present invention the oil may be extracted in a liquid/liquid extraction with the peroxide-acid reagent, or it may be contacted with the peroxide-acid reagent immobilized on a solid support.

About 0.005 to 8.0, and preferably about 0.005 to 2.0, and most preferably, about 0.01 to 0.03, percent by volume of each of the hydrogen peroxide and the acid components of the reagent of the present invention is used in treating the oil therewith, when using the hydrogen peroxides and the acids as 10 to 50% and preferably 30 to 40%, by weight aqueous solutions. Correspondingly larger or smaller volumes of the hydrogen peroxide and acid components would be needed when more dilute, or less dilute, solutions of these reagents are used. The ozone is supplied in such amounts as are comparable to the amounts of hydrogen peroxide that would be required.

The peroxide and acid components are added to the oil, for the purposes of conducting the treatment therewith of the present invention, by adding such components together. The acid is used to form an acidified peroxide.

The treatment with the peroxide-acid reagent may be conducted at room temperature, of about 20°–25° C., although at higher temperatures a more rapid/efficient extraction may be effected. The liquid/liquid extraction may be done by vigorously shaking a mixture of the oil and the peroxide-acid reagent in commonly employed shaking devices designed to effect efficient liquid/liquid extraction systems. Depending on the amount of peroxide-acid reagent used, the size of the oil sample being extracted, and the amount of harsh flavor off-notes initially present in such sample, and the shaking device employed, the extraction time required may be about one to ten minutes.

Only one treatment of the oil with the peroxide-acid reagent is needed in order to adequately accomplish the removal of the harsh flavor off-notes. With such a treatment all of the harsh flavor notes are readily removed.

After the aqueous peroxide-acid reagent is used to treat the essential oil in the liquid/liquid extraction process, it is readily moved therefrom by the use of oil/water separating devices such as a separatory funnel, with or without prior centrifuging. Residual traces of the peroxide-acid reagent can be further readily extracted from the oil by treatment with a solution of $Na_2CO_3$ (to neutralize the acid) followed by washing with distilled water. The oil is then dried by high speed centrifugation.

Contrary to the teachings of U.S. Pat. No. 4,478,864, whereby the agent which would cause the creation of the off flavor note (upon aging in the oil) is actually removed from the fresh oil as a menthofuran-maleic anhydride complex, the agent(s) which are causing the off-flavor notes in the fresh oil, and which are treated with the peroxide-acid reagent according to the present invention, are not removed from the fresh oil by such treatment. The peroxide-acid reagent presumably oxidizes the agents causing the off-flavor notes in such a way as to then render them innocuous from an off-flavor point of view. Thus, it is not necessary to further age the fresh oil, as is otherwise commonly done, to accomplish the same result.

The treatment of the fresh essential oil with the peroxide-acid reagent can be accomplished before or after any treatment of the oil according to the process of U.S. Pat. No. 4,478,864.

The various types of products into which the essential oils of the present invention may be added as flavors or fragrances would include food, confectionary, including chewing gum and pressed mints, perfumes, cosmetic and body hygiene products and medicinals.

The following examples are merely illustrative of the scope of the present invention and are not intended as a limitation upon the scope thereof.

EXAMPLE 1

A 100 ml sample of freshly distilled peppermint oil is shaken, in a 250 ml separatory funnel, with 0.02 grams each of 30% by weight aqueous $H_2O_2$ and 12N HCl for 1 to 2 minutes. The aqueous (bottom) layer is discarded after complete separation of the layers. The peppermint oil layer is washed by extraction with 2×50 ml 5% sodium carbonate solution and 2×50 ml distilled water, and the completely separated aqueous layer is then discarded. The oil is dried with 4 g anhydrous sodium sulfate and by centrifugation at 2000 to 3000 rpm.

The resulting oil is crystal clear and possesses a clean characteristic mellow aroma of a good quality aged peppermint oil. The harsh objectionable aroma of the starting oil is eliminated. The taste of the treated oil, when evaluated in a sugar fondant at 0.2 weight percent level and in a chewing gum at about a 0.5 to 1.5 weight percent level, is similarly improved from that of the starting oil.

EXAMPLE 2

A sample of freshly distilled spearmint oil is also treated according to the procedure of Example 1. A similar improvement of the treated oil is noted.

The magnitude of improvement in a treated oil depends on the quality of the starting oil; the more objectionable and the harsher the starting oil is, the more dramatic is the improvement obtained by the treatment thereof according to the present invention.

What is claimed is:

1. A process for removing harsh flavor off-notes from the distilled essential oil of a botanical material selected from mentha which comprises extracting said oil, in a liquid-liquid extraction process, with such amounts of aqueous acidified oxidizing agent as are sufficient to remove at least substantially all of said harsh flavor notes present in said oil, said acidified oxidizing agent being formed from a water soluble inorganic acid and an oxidizing agent which is selected from the group consisting of hydrogen peroxide, ozone and mixtures thereof.

2. A process as in claim 1 in which said acid is selected from the group consisting of hydrochloric acid, sulfuric acid and phosphoric acid.

3. A process as in claim 1 in which said oxidizing agent and said acid are hydrogen peroxide and hydrochloric acid.

4. A process as in claim 1 in which said essential oil is peppermint oil.

5. A process as in claim 1 in which said essential oil is spearmint oil.

6. A process as in claim 1 in which about 0.005 to 8.0% by volume of each of said hydrogen peroxide and said hydrochloric acid are used and in the form of 10 to 50% by weight aqueous solutions thereof.

* * * * *